US007309272B2

(12) United States Patent
Parpia

(10) Patent No.: US 7,309,272 B2
(45) Date of Patent: Dec. 18, 2007

(54) CHILD TRAINING SYSTEM

(76) Inventor: Narmin Parpia, 2615 Winston Ct., Pearland, TX (US) 77584

( * ) Notice: Subject to any disclaimer, the term of this patent is extended or adjusted under 35 U.S.C. 154(b) by 0 days.

(21) Appl. No.: 11/220,053

(22) Filed: Sep. 6, 2005

(65) Prior Publication Data

US 2006/0052031 A1 Mar. 9, 2006

Related U.S. Application Data

(60) Provisional application No. 60/607,629, filed on Sep. 7, 2004.

(51) Int. Cl.
*A63H 3/24* (2006.01)

(52) U.S. Cl. ..... 446/305

(58) Field of Classification Search ..... 446/305; 434/262, 267

See application file for complete search history.

(56) References Cited

U.S. PATENT DOCUMENTS 2,007,784 A * 7/1935 Wittmann ..... 446/380
2,012,060 A 8/1935 Wittmann
2,080,439 A * 5/1937 Schaeffer ..... 446/305
2,155,448 A * 4/1939 Schaeffer ..... 446/305
2,157,763 A 5/1939 Konikoff et al.
2,572,795 A * 10/1951 Wood et al. ..... 446/305
2,689,430 A * 9/1954 Freeland ..... 446/184
2,907,139 A 10/1959 Rekettye
2,945,321 A 7/1960 Carter
3,775,901 A 12/1973 Ellman et al.
3,839,819 A 10/1974 Hollingsworth et al.
4,160,338 A 7/1979 Lyons et al.
4,413,441 A 11/1983 Hunter et al.
5,509,808 A 4/1996 Bell
5,725,382 A 3/1998 Walter et al.
6,033,229 A * 3/2000 Scherman et al. ..... 434/267
6,234,862 B1 5/2001 Wittenberg
6,709,310 B1 3/2004 Pietrafesa
2001/0029146 A1 * 10/2001 Llorens ..... 446/305

* cited by examiner

*Primary Examiner*—John A. Ricci
(74) *Attorney, Agent, or Firm*—Raymond R. Ferrera

(57) ABSTRACT

A child training system is provided, including a doll having a soft, hollow compressible leg reservoir; a hollow torso; a head formed with a mouth orifice into which liquid can be introduced; and a liquid discharge orifice containing a supply assembly of tubing and a check valve disposed so as to supply liquid to the leg reservoir.

18 Claims, 1 Drawing Sheet

CHILD TRAINING SYSTEM

STATEMENT OF RELATED CASES

Pursuant to 35 U.S.C. 119(e)(1), reference is hereby made to prior provisional application No. 60/607,629, filed Sep. 7, 2004.

FIELD OF THE INVENTION

The present invention relates generally to dolls used in physiological and psychological training systems for children, and more particularly to a system of toilet training children using anatomically accurate dolls that simulate actual micturition positions.

BACKGROUND OF THE INVENTION

Wetting dolls or figures are well known in the art and have been presented in various embodiments for many years. Generally, a wetting doll includes an orifice for intake of liquid, a reservoir within the doll for holding the liquid, and an orifice for expulsion of the liquid from the doll. The expulsion of the liquid simulates the wetting action of the doll. Expulsion of the liquid may be controlled or uncontrolled, with various degrees of control and various mechanisms for effectuating such controlled expulsion. Controlled expulsion may include a delay in expulsion, a control limiting the amount of expulsion, a requirement for certain positioning of the doll, triggering from some external component, or manual pumping action from the user. The controlled expulsion may be combined with other simulations, such as production of tears, burping, or spitting. The various doll presentations exhibit a wide range of simulation accuracy in the reproduction of these physiologic functions.

U.S. Pat. No. 2,907,139 to Rekettye teaches a wetting doll having a gravity-influenced reservoir, allowing for the repeated discharge of small amounts of liquid. Rekettye teaches placing the reservoir in the head and positioning the doll upright as a means to release liquid from the reservoir for discharge.

U.S. Pat. No. 4,160,338 to Lyons et al. teaches a sound emitting and wetting doll having air bellows in the doll's body and head, a mouthpiece chamber, and a de-tuned reed, allowing for the simulation of delayed burping and spitting in addition to wetting. A simulated feeding bottle must be squeezed to fill the mouthpiece chamber. The doll automatically wets when the doll is placed in the upright position with the mouthpiece chamber filled.

U.S. Pat. No. 3,775,901 to Ellman et al. teaches a child's doll having a reservoir for fluid, a discharge valve that may be opened by a magnetic field, and a magnet attached to the seat of a toy chamber pot.

U.S. Pat. No. 3,839,819 to Hollingsworth et al. teaches a controlled wetting unit for a doll having a reservoir placed within the doll's torso, a manual squeeze bulb, and flow control valve. Hollingsworth et al. teaches a reservoir configuration that prevents premature wetting during the filling of the reservoir. Manual pumping of the squeeze bulb allows emptying of the reservoir and wetting while the doll is in the upright position. The purpose is to place wetting under control of the child.

U.S. Pat. No. 4,413,441 to Hunter et al. teaches a controlled wetting function doll having a reservoir for fluid in the doll's head, a pinch valve, and accompanying toy toilet. A hidden lever that is actuated by placement on the toy toilet opens the pinch valve.

U.S. Pat. No. 6,033,229 to Scherman et al. teaches a male doll medical device having a removable reservoir, external hand pump, and doll hands that may attach to the simulated human penis. The instructor hides the external hand pump behind a stand, which is also used to hold the doll in a standing position.

These teachings share a limitation in that wetting action is dependent upon the position of the doll. Those with controlled wetting mechanisms tend to require special actuation or positioning which distracts from the natural wetting experience. Squeeze bulbs for manual pumping tend to be located such that the doll must be incorrectly handled to actuate the pumping action, disrupting the simulation of the wetting action. These various configurations do not lend themselves to simulation of actual toilet training, as the dolls tend to have to be handled in an unnatural way to pump the liquid, such as pressing a thumb into the back of the doll, or the doll has to be in a seated position to accomplish wetting action. For seat-actuated dolls, the dolls must be precisely and fully seated to actuate the wetting function. This prevents a toilet training instructor from fully demonstrating the process of seating and urination, as the instructor is not able to position the doll in successive increments of the seating movement. This also prevents the instructor from controlling the wetting action throughout the duration of the seating movement. Additionally, a toilet training instructor is not able to demonstrate urination while standing. For back actuated dolls, the toilet training instructor projects confusing signals to the trainee, owing to the awkward positioning of the instructor's hands about the doll's torso to actuate the wetting.

SUMMARY OF THE INVENTION

A training doll is provided, wherein the doll includes a mouth orifice; a leg reservoir having a first end and a distal end; a first fluid communication means for communicating fluid from said mouth orifice into said leg reservoir; a bottom orifice; a second fluid communication means for communicating fluid from said distal end of leg reservoir to said bottom orifice; a pneumatic exiting means for expelling pneumatic fluid from said leg reservoir during the receipt of fluids from said first communication means into said leg reservoir; said leg reservoir being at least partially deformable by pressure, thereby allowing liquid to pass from said leg reservoir to said bottom orifice to simulate wetting.

Also provided is a doll having a mouth; a first end of a first check valve in fluid communication with said mouth; a first end of a deformable reservoir in fluid communication with a second end of the first check valve; a first end of a second check valve in communication with said first end of the deformable reservoir; a first end of a passageway in fluid communication with the proximate interior of a second end of the deformable reservoir; a bottom orifice in communication with a second end of said passageway; wherein the second check valve allows the expulsion of pneumatic fluid from the deformable reservoir upon entry of fluid from the first check valve and the passageway expelling fluid upon compression of the deformable reservoir; wherein the deformable reservoir returns substantially to its original shape upon release of said compression.

A system for toilet training is also provided, the system including a compressible leg reservoir; a torso; a head formed with a mouth orifice into which liquid can be introduced; the torso further including an orifice for discharge of liquid; and a first check valve and tubing assembly to supply liquid to said leg reservoir; the leg reservoir further including an inlet to receive liquid; and an outlet having a second check valve for equalizing pressure in said leg reservoir with atmosphere; and a liquid flow means for flowing liquid from said leg reservoir to said discharge orifice in said torso when said leg reservoir is compressed.

Finally, a method of practicing the invention is provided, the method including providing a doll having a leg actuated wetting means; placing the doll proximate to a toilet using a position selected from the group essentially consisting of standing, leaning, crouching, sitting and squatting; and actuating the wetting means to expel liquid to simulate urination.

OBJECTS OF THE INVENTION

A first object of the invention is to provide a doll having a unique mechanism for simulating the drinking and wetting functions.

Another object of the invention is to simulate the elimination or wetting function in any position, such as sitting or standing. This is especially important for the boy doll, as the doll may be used to demonstrate urination from a standing position.

It is a further object of the present invention to alternatively provide anatomically accurate representations of the urethral openings of the male or female external genitalia associated with urination.

It is an advantage of the present invention that toilet training may now be easily demonstrated in a fun, objective, and non-traumatic manner. The present invention provides the opportunity for early intervention to avoid impaired physiological development or development of associated psychological issues.

Another advantage of the present invention is the ability to apply different outfits to the doll at various stages of the training process. This enables the doll to wear age-appropriate clothing that maintains identity between the doll and the trainee. For example, the doll may begin with diapers, graduate to pull-ups, toddler clothing, and eventually age-appropriate underwear.

The doll may be provided in different sizes to reflect the various growth stages of childhood, and/or equipped with indicia of advancing maturity such as longer hair, proportionally sized genitalia, etc.

The doll may also be used to supplement or reinforce methods practiced by instructors who use elimination communication techniques.

REFERENCE NUMERALS IN THE DRAWINGS

Figure 1:
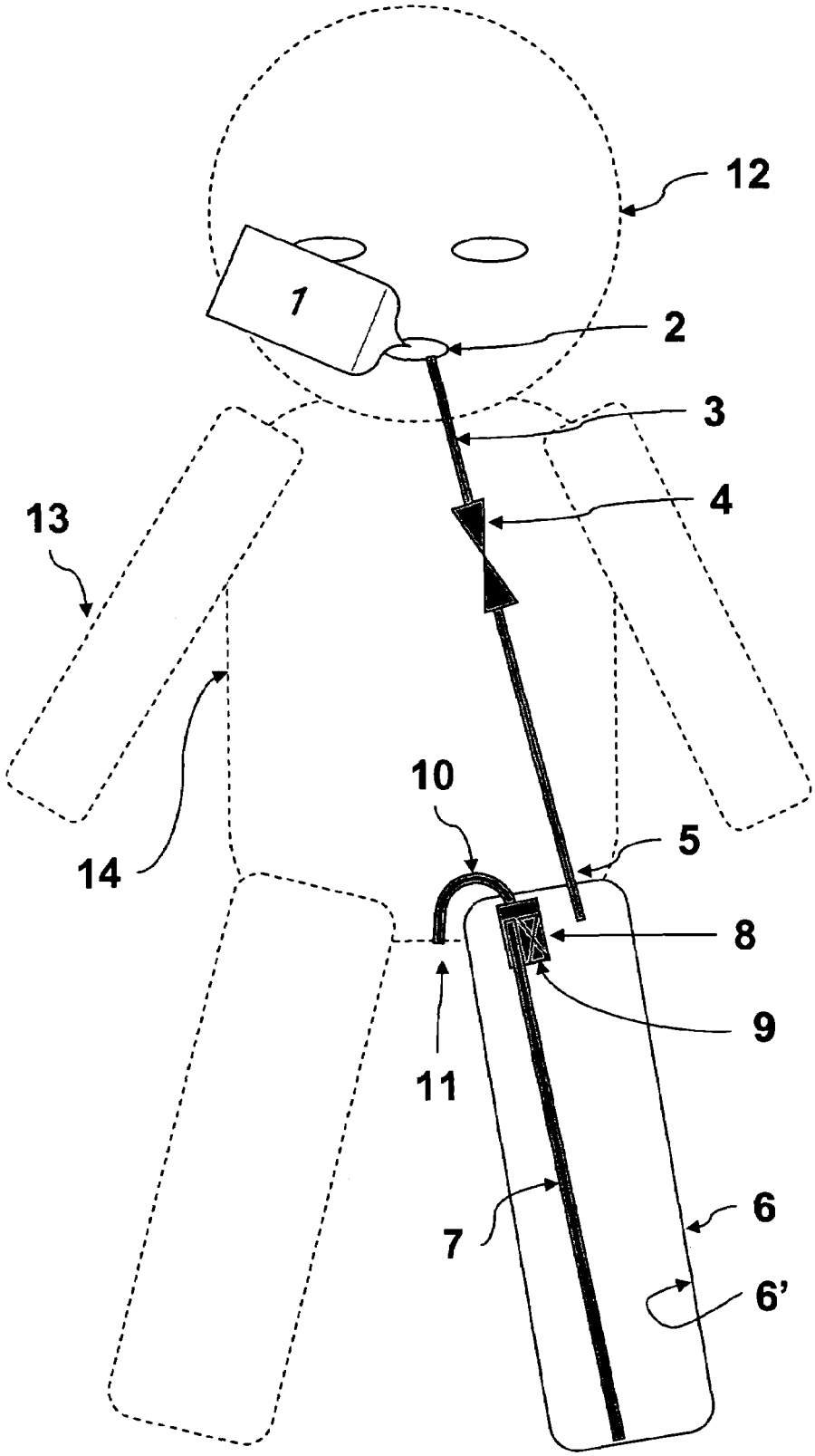
FIG. 1 shows a frontal diagrammatic view illustrating a doll constructed in accordance with the present invention.

The following elements are numbered as described in the drawings and detailed description of the invention:

| | | | |
|---|---|---|---|
| 1 | bottle | 2 | mouth orifice |
| 3 | first tubing | 4 | check valve |
| 5 | second tubing | 6 | legs - 6' leg reservoir |
| 7 | third tubing | 8 | manifold |
| 9 | air check valve | 10 | fourth tubing |
| 11 | bottom orifice | 12 | head |
| 13 | arms | 14 | torso |

DETAILED DESCRIPTION OF THE DRAWINGS

As illustrated in FIG. 1, a training doll is provided, comprising a head 12, arms 13, a torso 14 and two legs 6. Generally, the doll may be made of any of a wide variety of materials, such as cloth, plastics, ceramic, porcelains, composites, wood, and combinations thereof. At least one leg 6 should be composed of a flexible material that may be compressed by a human hand. Head 12 includes a mouth orifice 2 which may be styled to simulate a human mouth. Preferably, mouth orifice 2 should be composed of a water-resistant material to receive liquids. Examples include plasticized polymeric materials as conventionally used in doll manufacture. Mouth orifice 2 is connected to one end of water-resistant first tubing 3. The opposite, second end of first tubing 3 is connected to a first end of check valve 4. Water-resistant first tubing 3 may be any of a variety of means of communicating fluid between mouth orifice 2 and check valve 4, such as a water-resistant passageway or molded cavity. A first end of second water-resistant tubing 5 is connected to a second end of check valve 4. The opposite, second end of second tubing 5 is connected to a first end of leg reservoir 6'. Check valve 4 provides a means for liquid to pass into leg reservoir 6' from mouth orifice 2 while preventing fluid from passing back from leg reservoir 6' into mouth orifice 2. Water-resistant second tubing 5 may be any of a variety of means of communicating fluid between mouth check valve 4 and leg reservoir 6', such as a water-resistant passageway or molded cavity. Leg reservoir 6' is preferably located in at least one of legs 6 and should be composed of a flexible material that may be compressed by a human hand. Leg 6 and leg reservoir 6' may be integrated together as a single unit. A first end of a third tubing 7 is located proximate to a second, distal end of leg reservoir 6'. A second end of third tubing 7 is connected to a first opening in manifold 8, preferably proximate to the first end of leg reservoir 6'. Third tubing 7 may be any of a variety of means of communicating fluid, such as a tube, straw, water-resistant passageway, or integrated sealed channel within the wall of leg reservoir 6'.

Manifold 8 provides a connection between the interior and the exterior of leg reservoir 6'. A second opening in manifold 8, in fluid communication with the first opening of manifold 8, provides fluid communication between the interior and the exterior of leg reservoir 6'. Manifold 8 may be constructed of molded plastic and affixed to, or integrated into, leg reservoir 6', or otherwise sealed to prevent fluid leakage from leg reservoir 6' into the doll.

A first end of air check valve 9 opens to the interior of leg reservoir 6', preferably located towards the first end of leg reservoir 6'. The second end of air check valve 9 opens to the exterior of leg reservoir 6'. Air check valve 9 provides a means for pneumatic fluid, such as air, to escape from leg reservoir 6' during the introduction of fluids from second tubing 5. Air check valve 9 may be integrated into manifold 8, but sealed from and not in fluid communication with the first or second openings of manifold 8.

A first end of fourth tubing 10 is connected to the second opening in manifold 8, resulting in fluid communication from the interior distal end of leg reservoir 6' to the exterior proximate first end of leg reservoir 6'. A second end of fourth tubing 10 is connected to a bottom orifice 11, located proximately towards the lower portion of torso 14, providing a fluid exit from the doll. Fourth tubing 10 may be any of a variety of means of communicating fluid between manifold 8 and bottom orifice 11, such as a water-resistant passageway or molded cavity. Preferably, bottom orifice 11 should be composed of a water-resistant material to expel liquids. Bottom orifice 11 may also be formed, or fitted, to represent anatomically accurate representations of the urethral openings of the male or female external genitalia associated with urination.

In operation, leg reservoir 6' is filled with water by placing a nipple bottle 1 into mouth orifice 2. A toilet training instructor or user squeezes bottle 2, causing the water to flow into first tubing 3 and opening check valve 4. The water continues to flow past check valve 4 into second tubing 5, entering into, and proximate to, the first end of leg reservoir 6'. The air inside leg reservoir 6' is vented through air check valve 9, preferably contained in manifold 8 which is also proximate to the first end of leg reservoir 6'. As the water accumulates in leg reservoir 6', third tubing 7 tends to not vent air or liquid as the pressure caused by the hydrostatic head of the water tends to exceed the low pressure resistance expressed at air check valve 9.

A toilet training instructor or user causes the doll to wet or simulate urination by squeezing leg 6 and corresponding leg reservoir 6'. A threshold pressure is exceeded, causing air check valve 9 to at least partially close, expressing relatively higher pressure resistance at air check valve 9. With air check valve 9 at least partially closed, third tubing 7 vents the increased pressure inside leg reservoir 6', typically by flowing water from the distal end of leg reservoir 6', through manifold 8 and fourth tubing 10 and exiting bottom orifice 11.

The operation is relatively independent of the position and orientation of the doll and is not dependent upon gravity to generate the wetting action. The toilet training instructor or user may carefully hold the doll in various sitting, squatting, or standing positions. To effect training, the toilet training instructor or user may hold the doll by the legs during demonstration to a trainee. At the appropriate time the toilet training instructor wishes demonstrate urination, a slight squeezing of the instructor's hand will pump leg reservoir 6', causing wetting action. Since the instructor's slight squeezing is not obvious, the trainee is not distracted or confused by superfluous motions. The trainee's concentration remains focused on the wetting action.

The training instructor is also able to demonstrate, free from obstruction, standing positions for male urination as well as partial sitting positions and other cultural variations, such as squatting. The training instructor may also demonstrate wetting mistakes with relative ease.

In operation, the doll may be graduated to wear age-appropriate clothing to maintain identity between the doll and the trainee. For example, the doll may begin with diapers, graduate to pull-ups, toddler clothing, and eventually age-appropriate underwear. Similarly, the physical appearance of the doll can change to reflect differences in a child's physiology at various stages; for example, the doll can be equipped with longer hair, proportionally sized genitalia, etc.

Although the description above contains many specifications, these should not be construed as limiting the scope of the invention but as merely providing illustrations of some of the presently preferred embodiments of this present invention. Persons skilled in the art will understand that the method and apparatus described herein may be practiced, including but not limited to, by the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there has been illustrated and described particular embodiments of the present invention, it will be appreciated that numerous changes and modifications will occur to those skilled in the art, and it is intended in the appended claims to cover those changes and modifications which fall within the true spirit and scope of the present invention.

The invention claimed is:

1. A training doll comprising:

a mouth orifice;

a leg reservoir having a first end and a distal end;

a first fluid communication means for communicating fluid from said mouth orifice into said leg reservoir, wherein said first fluid communication means further comprises a check valve;

a bottom orifice;

a second fluid communication means for communicating fluid from said distal end of leg reservoir to said bottom orifice, wherein said second fluid communication means further comprises a check valve;

a pneumatic exiting means for expelling pneumatic fluid from said leg reservoir during the receipt of fluids from said first communication means into said leg reservoir;

said leg reservoir being at least partially deformable by pressure, thereby allowing liquid to pass from said leg reservoir to said bottom orifice to simulate wetting.

2. The training doll of claim 1 wherein said first fluid communication means further prevents fluid communication from said leg reservoir into said mouth orifice.

3. The training doll of claim 1 wherein said pneumatic exiting means operates in either a standing position or a sitting position of said doll.

4. The training doll of claim 1 wherein said bottom orifice conforms to represent an anatomically accurate urethral opening.

5. The training doll of claim 1 wherein said bottom orifice conforms to represent an anatomically accurate male urethral opening.

6. The training doll of claim 1 wherein said bottom orifice conforms to represent an anatomically accurate female urethral opening.

7. The training doll of claim 1 wherein said leg reservoir is composed of a flexible material.

8. The training doll of claim 1 wherein said leg reservoir is composed of a plasticized polymeric material.

9. The training doll of claim 1 wherein said mouth orifice is composed of a water resistant material.

10. The training doll of claim 1 wherein said mouth orifice is composed of a plasticized polymeric material.

11. A method of toilet training comprising the step of positioning the doll of claim 1 in a micturition position selected from the group consisting essentially of sitting, standing and squatting.

12. A doll comprising:

a mouth;

a first end of a first check valve in fluid communication with said mouth;

a first end of a deformable reservoir in fluid communication with a second end of said first check valve;

a first end of a second check valve in communication with said first end of said deformable reservoir;

a first end of a passageway in fluid communication with the proximate interior of a second end of said deformable reservoir;

a bottom orifice in communication with a second end of said passageway;

said second check valve allowing the expulsion of pneumatic fluid from said deformable reservoir upon the entry of fluid from said first check valve and said passageway expelling fluid upon compression of said deformable reservoir; and said deformable reservoir returning substantially to original shape upon release of said compression.

13. The doll of claim 12 wherein said deformable reservoir is located in at least one leg of said doll.

14. The doll of claim 12 wherein said bottom orifice simulates the appearance of external genitalia.

15. The doll of claim 12 wherein said bottom orifice simulates the appearance of external male genitalia.

16. The doll of claim 12 wherein said bottom orifice simulates the appearance of a urethral opening.

17. The doll of claim 12 wherein said bottom orifice simulates the appearance of a male urethral opening.

18. A system for toilet training, said system:

a compressible leg reservoir;

a torso;

a head formed with a mouth orifice into which liquid can be introduced;

said torso further comprising:

an orifice for discharge of liquid; and a first check valve and tubing assembly to supply liquid to said leg reservoir;

said leg reservoir further comprising:

an inlet to receive liquid; and an outlet having a second check valve for equalizing pressure in said leg reservoir with atmosphere; and a liquid flow means for flowing liquid from said leg reservoir to said discharge orifice in said torso when said leg reservoir is compressed.

* * * * *